US008132995B2

(12) United States Patent
Adler et al.

(10) Patent No.: US 8,132,995 B2
(45) Date of Patent: Mar. 13, 2012

(54) BOOK BINDING MACHINE WITH A BOOK BLOCK TRANSPORT SYSTEM AND LUBRICATION CLAMP FOR A BOOK BLOCK TRANSPORT SYSTEM IN A BOOK BINDING MACHINE

(75) Inventors: Michael Adler, Leipzig (DE); Rolf Böttcher, Markkleeberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 698 days.

(21) Appl. No.: 12/190,679

(22) Filed: Aug. 13, 2008

(65) Prior Publication Data

US 2009/0047101 A1 Feb. 19, 2009

(30) Foreign Application Priority Data

Aug. 16, 2007 (DE) ..... 10 2007 038 557

(51) Int. Cl.
*B42C 11/00* (2006.01)
*B42C 9/00* (2006.01)
*B42C 13/00* (2006.01)
*B42C 5/06* (2006.01)

(52) U.S. Cl. ..... 412/25; 412/4; 412/5; 412/9; 412/11; 412/22; 412/29; 412/34

(58) Field of Classification Search ..... 412/4, 5, 412/9, 11, 22, 25, 29, 34, 40
See application file for complete search history.

(56) References Cited

U.S. PATENT DOCUMENTS 2,921,322 A * 1/1960 Crawley et al. ..... 412/22
3,474,593 A * 10/1969 Hartbauer et al. ..... 412/34
2004/0197163 A1* 10/2004 Spiel ..... 412/40

FOREIGN PATENT DOCUMENTS

DE 20 2005 007 012 U1 4/2005

OTHER PUBLICATIONS

German Patent and Trademark Office Search Report, dated Jun. 10, 2008.

* cited by examiner

*Primary Examiner* — Dana Ross
*Assistant Examiner* — Justin Lewis
(74) *Attorney, Agent, or Firm* — Laurence A. Greenberg; Werner H. Stemer; Ralph E. Locher

(57) ABSTRACT

A book binding machine includes a book block transport system and a plurality of clamps for clamping stacks of leaves. The clamps are disposed at a distance from each other and are guided in guide tracks of a machine frame. The book block transport system includes a clamp, which is also referred to as a lubrication clamp, having a device for lubricating the guide track. An applicator is assigned to each track roller of the clamp, and the lubricant is transferred to the track rollers through the use of a respective applicator such as a brush. The track rollers transfer the lubricant to contact surfaces of the guide track. A lubrication clamp for a book block transport system in a book binding machine, is also provided.

14 Claims, 4 Drawing Sheets

BOOK BINDING MACHINE WITH A BOOK BLOCK TRANSPORT SYSTEM AND LUBRICATION CLAMP FOR A BOOK BLOCK TRANSPORT SYSTEM IN A BOOK BINDING MACHINE

CROSS-REFERENCE TO RELATED APPLICATION

This application claims the priority, under 35 U.S.C. §119, of German Patent Application DE 10 2007 038 557.0, filed Aug. 16, 2007; the prior application is herewith incorporated by reference in its entirety.

BACKGROUND OF THE INVENTION

Field of the Invention

The invention relates to a book binding machine having a transport system and a plurality of driven clamps for clamping stacks of leaves, collated signatures, book blocks or the like. The clamps are disposed at a distance from each other and a guide track is supported in a machine frame for guiding the clamps. The invention also relates to a lubrication clamp for a book block transport system in a book binding machine.

Book binding machines of that type, such as adhesive binders, also known as perfect binders, are used to produce adhesive-bound brochures or book blocks for hard covers. The signatures and/or individual leaves are collated to form a book block and are connected by applying an adhesive to the prepared spine of the block. The equipment of the machine determines the available binding processes and the variety of products than can be produced. The machine equipment is substantially formed of the following functional units: book block transport system, spine preparation, application of glue to the spine, intermediate drying, application of glue to the sides, reinforcement of the spine, cover feeding, cover pressing and drying.

German Utility Model DE 20 2005 007 012 U1 illustrates a book binding machine of that type with a book block transport system. The book block transport system is formed of conveying devices which are guided by deflection wheels and a plurality of clamps which are disposed at equal distances from each other to clamp stacks of leaves.

In accordance with the prior art, the conveying devices are preferably roller chains with individually movable chain links which interlock with each other. The chains serve to advance/drive the clamps. However, guide tracks which are firmly connected to the machine frame of the book binding machine are provided to guide the clamps. Each clamp has a number of track rollers which roll on the contact surface of the guide track.

In order to avoid wear of the track rollers and guide track, those two must be carefully lubricated at regular intervals. There are two ways to do that: either the guide track has a central lubrication system with lubricant channels, or the guide track is lubricated manually through the use of a brush or aerosol can. A disadvantage of the central lubrication system is that excess lubrication may occur and cause soiling of the products whereas other sections of the guide track run without sufficient lubrication. A disadvantage of manual lubrication is that in terms of quality and quantity, the lubrication depends on the skill and experience of the operator.

SUMMARY OF THE INVENTION

It is accordingly an object of the invention to provide a book binding machine with a book block transport system and a lubrication clamp for a book block transport system in a book binding machine, which overcome the hereinaforementioned disadvantages of the heretofore-known devices of this general type and which provide better lubrication of contact surfaces of track rollers and guide tracks.

With the foregoing and other objects in view there is provided, in accordance with the invention, in a book binding machine, a transport system, comprising a plurality of driven clamps disposed at a distance from each other for clamping stacks of leaves, collated signatures, book blocks or the like, a guide track supported in a machine frame for guiding the clamps, and at least one lubrication device associated with at least one of the clamps for lubricating the guide track.

It is an advantage of the invention that the contact surfaces can be provided with a uniform lubrication film and no excess lubricant or sections with a lack of lubricant occur.

Therefore, the book binding machine of the invention includes a transport system with a plurality of driven clamps. The clamps are used to clamp stacks of leaves, collated signatures, book blocks, or the like and are disposed at a distance from each other. The clamps are transported through the book binding machine along different processing stations. For this purpose, the clamps are guided on a guide track which is supported in a machine frame. The transport system of the book binding machine advantageously includes at least one clamp which has a device for lubricating the guide track.

In accordance with another feature of the invention, the clamps are guided by track rollers, in particular roller bearings.

In accordance with a further feature of the invention, the lubrication device has at least one reservoir containing a lubricant. In accordance with a first variant, the at least one reservoir is attached to the at least one clamp including the lubrication system and is moved together with the clamp. In this context, the reservoir may be a grease or oil cup. In accordance with an advantageous refinement, the lubrication device includes one reservoir for each contact surface of the guide track.

In accordance with an added alternative feature of the invention, the at least one reservoir is attached to the machine frame and connected to the at least one clamp including the lubrication device, by lines. Such a reservoir is advantageously disposed at a central location and is not moved with the clamps.

In accordance with an additional feature of the invention, at least one lubricant applicator is provided for each contact surface of the guide track. The lubricant is transferred to the track rollers through the use of a respective applicator and is transferred from the track rollers to the contact surfaces of the guide track. In accordance with an alternative embodiment, likewise at least one applicator is provided for each contact surface. However, the lubricant is applied directly to the guide track through the use of a respective applicator. In both alternatives, the applicators may transfer the lubricant with contact, for instance through the use of brushes, or without contact, for instance through the use of spray valves.

In accordance with yet another feature of the invention, the reservoirs of the lubrication device are connected to the applicators by lines. The reservoirs are equipped with a pressure control to control the amount of lubricant provided at the applicators. The higher the pressure in the reservoirs, the more lubricant will be provided at the applicators. In accordance with an alternative embodiment, the reservoirs of the lubrication device are likewise connected to the applicators by lines but the lines are equipped with valves to control the amount of lubricant provided at the applicators.

With the objects of the invention in view, there is concomitantly provided a lubrication clamp for a book block transport system in a book binding machine. The lubrication clamp comprises track rollers and a lubrication device transferring a lubricant to the track rollers.

Other features which are considered as characteristic for the invention are set forth in the appended claims.

Although the invention is illustrated and described herein as embodied in a book binding machine with a book block transport system and a lubrication clamp for a book block transport system in a book binding machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
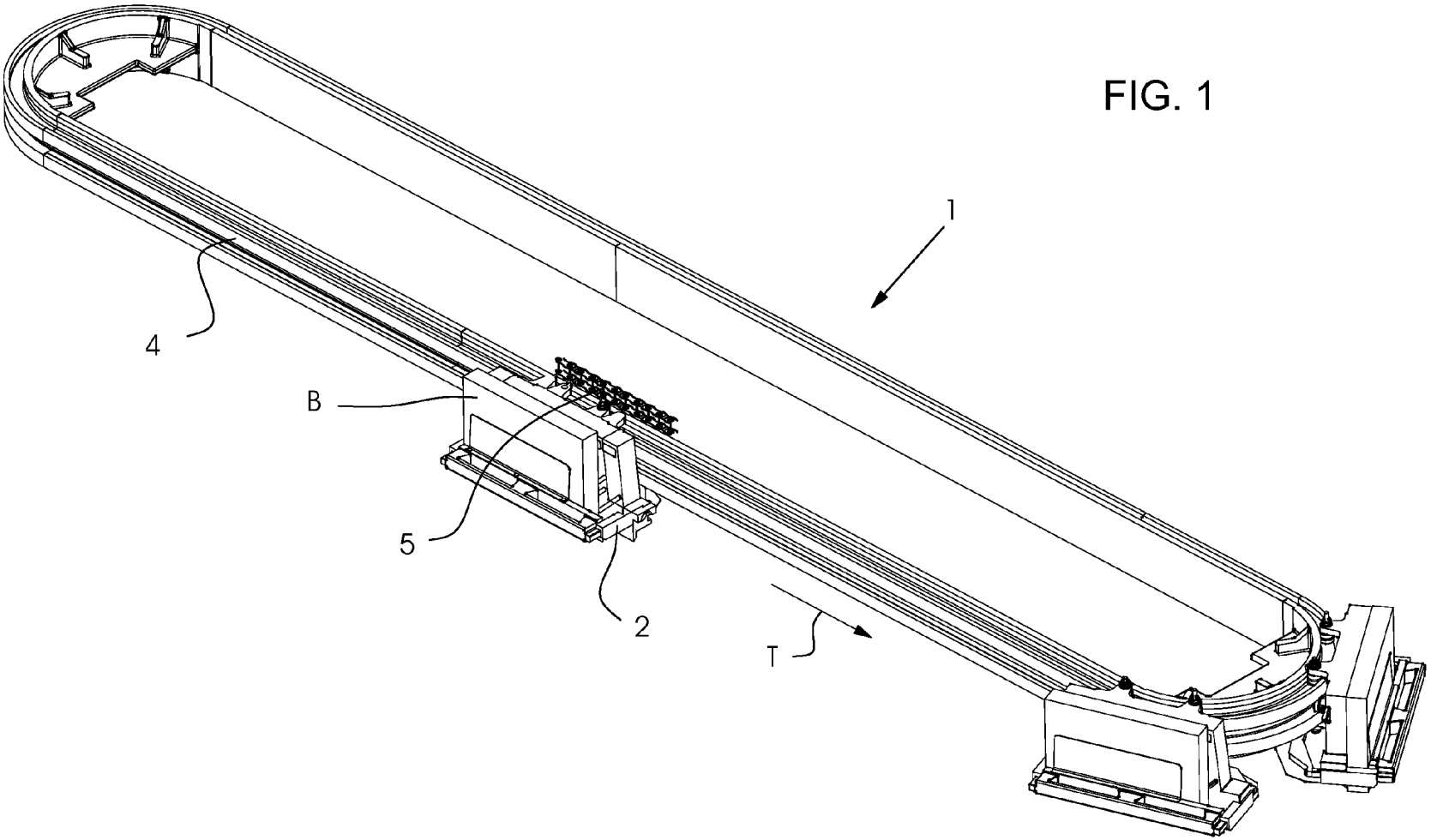
FIG. 1 is a diagrammatic, perspective view of a guide track of a book binding machine including a number of clamps.
Figure 2:
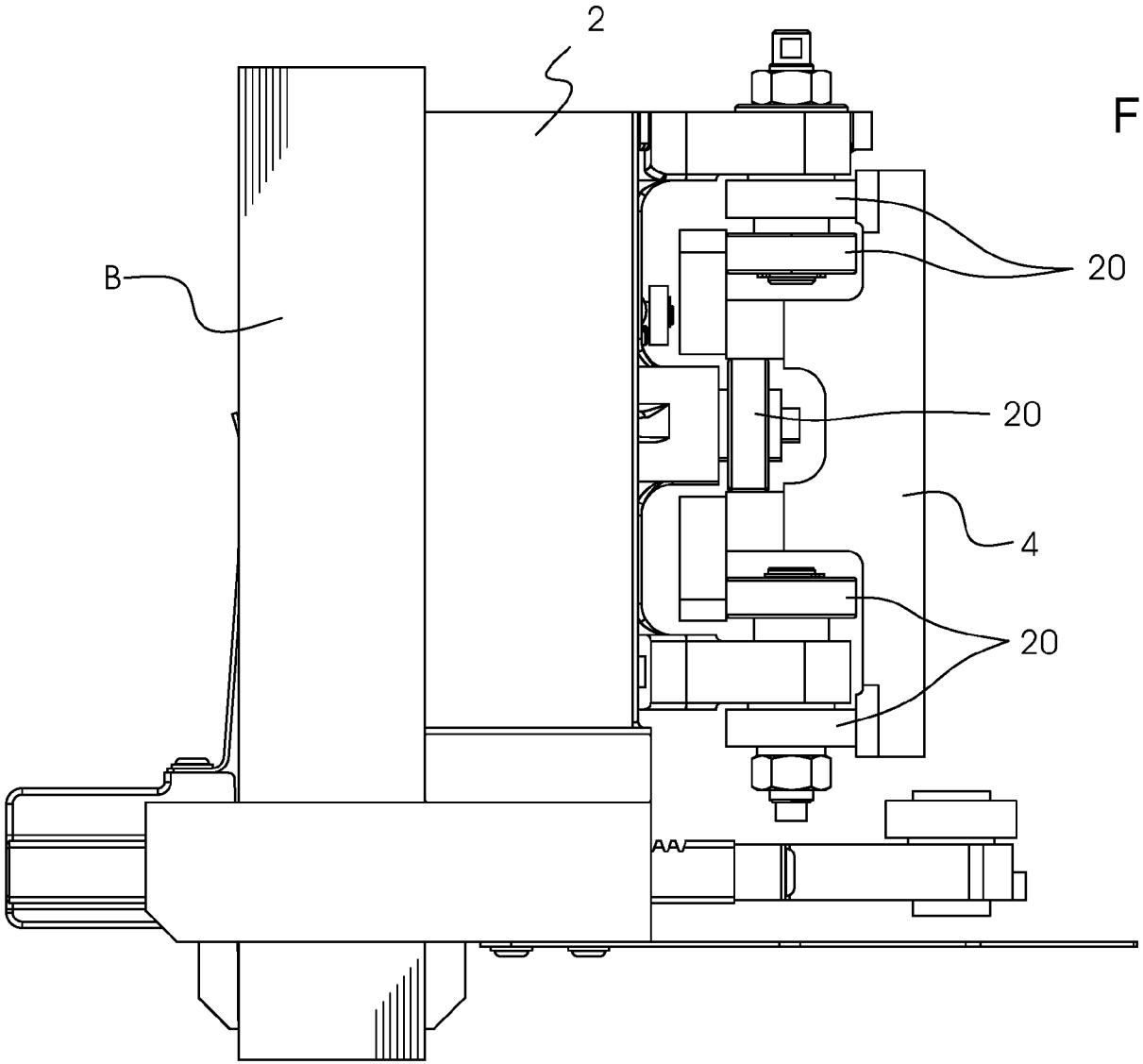
FIG. 2 is a side-elevational view of a clamp.

Referring now to the figures of the drawings in detail and first, particularly, to FIG. 1 thereof, there is seen a book block transport system 1 of a non-illustrated book binding machine. The book block transport system 1 is formed of several clamps 2, a chain 5 and a guide track 4. The clamps 2 are disposed equidistantly from each other on the chain 5. The chain 5 is driven by a non-illustrated electric motor and is guided by non-illustrated deflection wheels. Since the clamps 2 are connected to the chain 5, the clamps 2 move with the chain 5 in a transport direction T. The clamps 2 are guided by the guide track 4. As is shown in FIG. 2, each clamp 2 (including a lubrication clamp 3 illustrated in FIG. 3) has a plurality of track rollers 20 which roll on the guide track 4.

Each clamp 2 clamps a book block B to transport it along the guide track 4 in the transport direction T from one non-illustrated processing station to the next.

Figure 3:
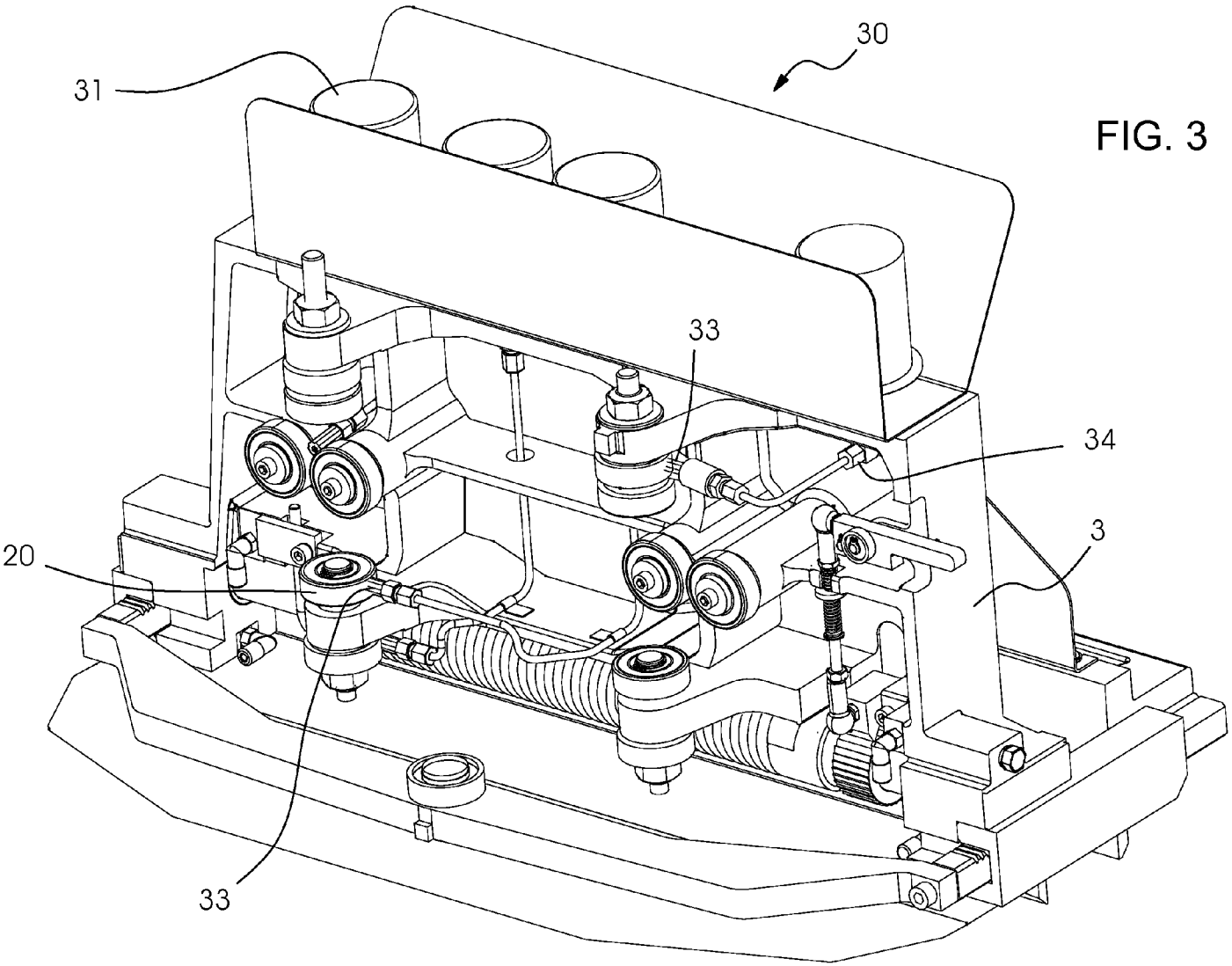
FIG. 3 is a perspective view of a lubrication clamp according to the invention.

FIG. 3 illustrates a lubrication clamp 3 in accordance with the invention. The lubrication clamp 3 includes a lubrication device 30 which is formed of a reservoir, for example oil or grease cups 31 containing a lubricant, and of applicators 33. In the illustrated example, the applicators 33 are brushes. The reservoir 31 and the applicators 33 are connected to each other by lines 32 seen in FIG. 4. The amount of lubricant which is transferred from the applicators 33 to the track rollers 20 can be controlled through the use of valves 34. As is shown in FIG. 3, an applicator 33 is associated with each respective track roller 20. The track rollers 20 of the lubrication clamp 3 transfer the lubricant to a contact surface of the guide track 4, which is not illustrated in FIG. 3. Thus, uniform lubrication of all contact surfaces is provided.

Figure 4:
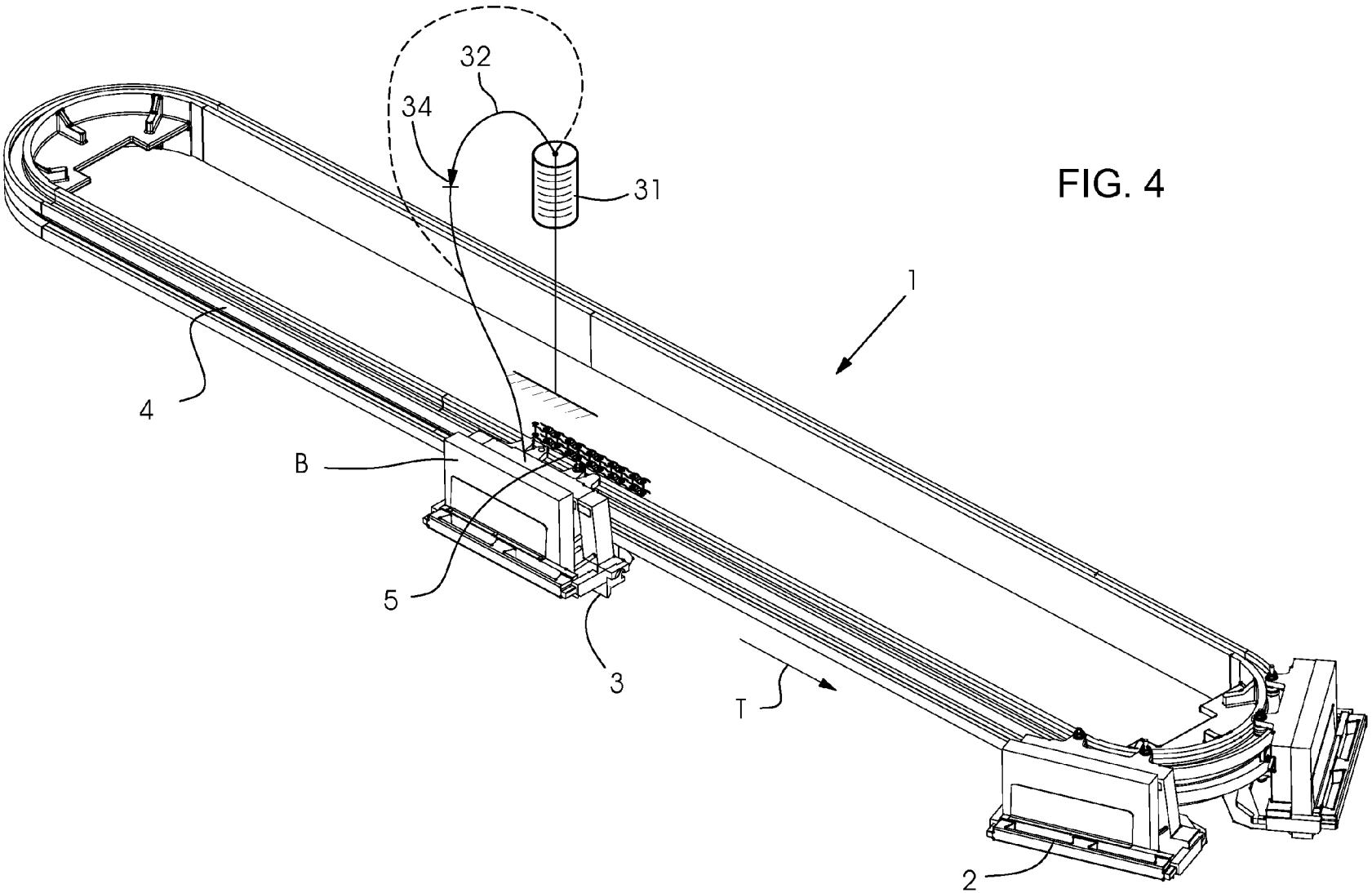
FIG. 4 is a perspective view of a guide track including a lubrication clamp and a central lubricant supply.

FIG. 4 illustrates an alternative embodiment of the lubricant supply. In this embodiment, a line 32 connects a lubricant reservoir 31 to a clamp 3 having a lubrication device. The lubricant reservoir 31 is firmly connected to a machine frame and is in a slightly elevated central position at the center of the revolving guide track 4. The line 32 includes a valve 34 for controlling the amount of lubricant which is transferred to the clamp 3. The line 32 is made of a flexible material and can be easily moved (as is indicated by the dashed representation of the line). The length of the line 32 is sufficient to ensure that despite the revolving movement of the clamp 3, the latter is permanently connected to the reservoir 31.

The invention claimed is:

1. In a book binding machine, a transport system, comprising:

a plurality of driven clamps disposed at a distance from each other, said driven clamps being configured for clamping at least stacks of leaves, collated signatures or book blocks;

a guide track supported in a machine frame configured for guiding said clamps thereon; and at least one lubrication device associated with at least one of said clamps and being configured for lubricating said guide track, said at least one lubrication device including at least one reservoir containing a lubricant, said at least one reservoir being attached to and moving together with said clamp associated with said at least one lubrication device.

2. The book binding machine according to claim 1, wherein said clamps are guided on said guide track by track rollers.

3. The book binding machine according to claim 1, wherein said guide track has contact surfaces, and said lubrication device includes a respective reservoir for each one of said contact surfaces of said guide track.

4. The book binding machine according to claim 1, which further comprises contact surfaces of said guide track, track rollers guiding said clamps on said guide track, and at least one applicator for each respective contact surface including a respective applicator transferring the lubricant to said track rollers, said track rollers transferring the lubricant to said contact surfaces of said guide track.

5. The book binding machine according to claim 1, which further comprises contact surfaces of said guide track, and at least one applicator for each respective contact surface including a respective applicator transferring the lubricant to said guide track.

6. The book binding machine according to claim 4, wherein said applicators transfer the lubricant by contact with said track roller.

7. The book binding machine according to claim 5, wherein said applicators transfer the lubricant by contact with said contact surface.

8. The book binding machine according to claim 4, wherein said applicators transfer the lubricant without contact.

9. The book binding machine according to claim 5, wherein said applicators transfer the lubricant without contact.

10. The book binding machine according to claim 4, wherein said at least one reservoir of said lubrication device is connected to said applicators by lines having valves for controlling an amount of lubricant provided at said applicators.

11. The book binding machine according to claim 5, wherein said at least one reservoir of said lubrication device is connected to said applicators by lines having valves for controlling an amount of lubricant provided at said applicators.

12. The book binding machine according to claim 4, wherein said at least one reservoir of said lubrication device is connected to said applicators by lines, and said at least one reservoir has a pressure control for controlling an amount of lubricant provided at said applicators.

13. The book binding machine according to claim 5, wherein said at least one reservoir of said lubrication device is connected to said applicators by lines, and said at least one reservoir has a pressure control for controlling an amount of lubricant provided at said applicators.

14. A lubrication clamp for a book block transport system in a book binding machine, the lubrication clamp comprising:

track rollers; and a lubrication device transferring a lubricant to said track rollers, said lubrication device including at least one reservoir containing a lubricant, said at least one reservoir being attached to and moving together with said lubrication device.

* * * * *